United States Patent [19]

Andersson et al.

[11] Patent Number: 4,605,060

[45] Date of Patent: Aug. 12, 1986

[54] HEAT EXCHANGER PLATE

[75] Inventors: Jarl A. Andersson; Leif Hallgren, both of Lund, Sweden

[73] Assignee: Alfa-Laval AB, Tumba, Sweden

[21] Appl. No.: 517,529

[22] PCT Filed: Nov. 23, 1982

[86] PCT No.: PCT/SE82/00393

§ 371 Date: Jul. 19, 1983

§ 102(e) Date: Jul. 19, 1983

[87] PCT Pub. No.: WO83/01998

PCT Pub. Date: Jun. 9, 1983

[30] Foreign Application Priority Data

Nov. 26, 1981 [SE] Sweden ..... 8107040

[51] Int. Cl.[4] ..... F28F 3/00

[52] U.S. Cl. ..... 165/166; 165/146

[58] Field of Search ..... 165/146, 166, 167

[56] References Cited

U.S. PATENT DOCUMENTS

| | | | |
|---|---|---|---|
| 3,783,090 | 1/1974 | Andersson et al. | 165/166 |
| 4,423,772 | 1/1984 | Dahlgren | 165/166 |
| 4,431,050 | 2/1984 | Martin | 165/166 |

FOREIGN PATENT DOCUMENTS

| | | | |
|---|---|---|---|
| 2309743 | 10/1973 | Fed. Rep. of Germany | 165/166 |

*Primary Examiner*—Henry Bennett

*Attorney, Agent, or Firm*—Cyrus S. Hapgood

[57] ABSTRACT

A plate (1) for a plate heat exchanger is provided with a corrugation pattern of ridges (4) and grooves (3) intended to rest against the corrugation pattern on an adjacent plate so that a great number of supporting points (2) are formed. On at least one of its sides, the plate has ridges provided with recessed parts (5) positioned in the areas of the supporting points (2). Thus, the number of turbulence-generating supporting points and consequently the flow resistance are reduced in an adjacent heat exchanging passage (7).

6 Claims, 6 Drawing Figures

HEAT EXCHANGER PLATE

This invention relates to a plate for a plate heat exchanger provided with a corrugation pattern of ridges and grooves arranged to rest intersectingly against the corrugation pattern of an adjacent plate such that a great number of supporting points are formed. The function of the supporting points partly is to absorb compressive forces and partly to generate turbulence or increased convection, usually followed by increased pressure drop.

BACKGROUND OF THE INVENTION

In heat exchangers built up by plates with mutual intersecting corrugations it is known to change the flow resistence of the heat exchange passages and consequently also the so called thermal length by varying the press depth and the mutual angle of the corrugations of adjacent plates and by combining different press depths and angles. The possibilities to influence the flow characteristics of the passages with such arrangements, however, are limited to changes equal in size of the passages for the two media. A change of the passages for one of the media thus causes a corresponding change of the passages for the other medium.

The above mentioned limitation is a drawback since it is sometimes desirable to be able to bring about asymmetrical passages, i.e. to change the flow characteristics of the passages for the two media independently of each other, for instance when having the same type of medium in liquid state and the same allowed pressure drop and essentially the same viscosity and when the flows of the media are unequal in size, i.e. when the task of the heat exchange is asymmetrical. The heat exchanger in this example must be dimensioned for that medium that has the largest flow such that desired pressure drop is achieved in the passages through which this medium passes. Due to this fact the passages for the other medium, which have the same capacity, will be overdimensioned for the actual flow. Which medium that becomes limiting depends on size of flow, state of aggregation, the highest allowed pressure drop, type of fluid etc. Thus, also during condensation and/or evaporation the passages for one of the media usually becomes limiting, while the upper limit of the pressure drop for the other medium cannot be utilized. Accordingly, the heat exchanging surfaces of the apparatus are not utilized in the best way, which is unfavourable from an economic point of view.

In order to master this problem heat exchanger plates have been suggested provided with an unsymmetrical corrugation pattern having narrow ridges and wide grooves or vice versa. By means of such plates it is possible to bring about a heat exchanger, in which the passages for the two media have mutual different volume and consequently different flow characteristics. The difference in flow characteristics achieved in this way, however, is small at the same time as the area enlargement of the pattern has to be reduced. Therefore, this solution has appeared not to be so suitable in practice.

BRIEF DESCRIPTION OF DRAWINGS

The object of this invention is to bring about a heat exchanger plate making it possible to adapt the flow characteristics of the passages to mutual flows of unequal size of the two heat exchanging media under essential retention of area enlarging effect of the corrugation. In other words, each heat exchanging passage shall, if possible, have flow characteristics adapted to the medium flow passing through the passage. This has been achieved by means of a heat exchanger plate of the type mentioned by way of introduction, which plate according to the invention is characterized by the fact that at least on its one side it has ridges, provided with recessed parts arranged in the areas of the supporting points, whereby in an adjacent heat exchanging passage the number of supporting points generating convection or turbulence and consequently also the flow resistance are reduced.

DESCRIPTION OF THE DRAWINGS

Figure 1:
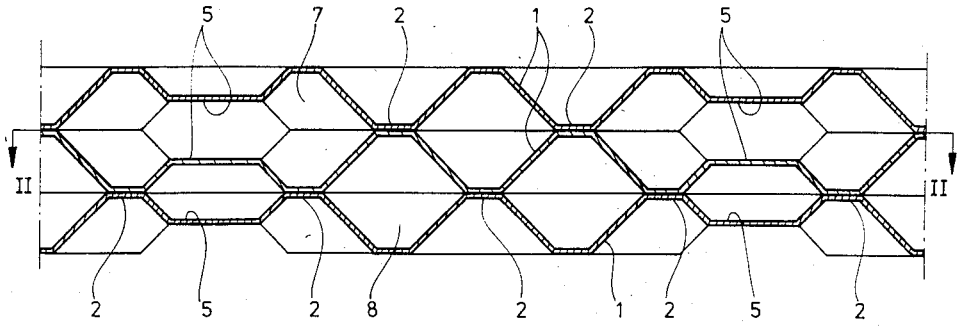
Figure 2:
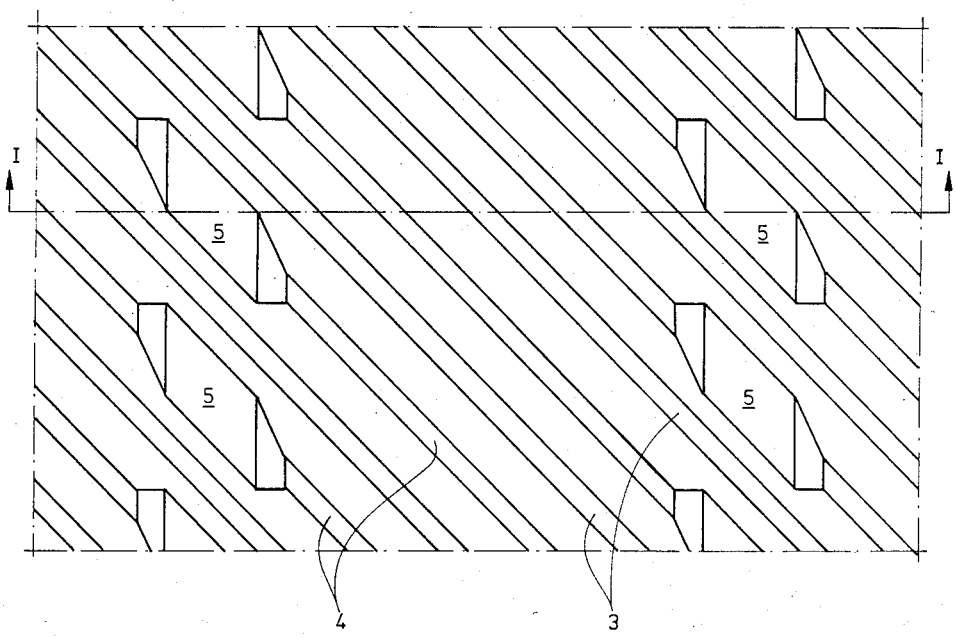

The invention is described more closely below with reference to the accompanying drawings, in which FIGS. 1 and 2 show a section and a plan view respectively of a fragment of a series of heat exchanger plates according to the invention and FIGS. 3–6 show corresponding views of other embodiments of the invention.

DETAILED DESCRIPTION OF THE INVENTION

FIG. 1 shows fragments of three identical plates 1, of which the intermediate one is turned 180° around its longitudinal axis in order to bring about a mutual intersecting corrugation pattern, which forms supporting points 2, in which the plates rest against each other. As is revealed in the best way in FIG. 2, the grooves 3 are running uninterruptedly, while the ridges 4 are provided with recesses 5 approximately positioned flush with the central plane of the plate. The recesses 5 are arranged in line with each other. As is revealed in FIG. 1 the recesses 5 are positioned on such places where corrugation ridges turned to each other intersect each other, whereby the number of supporting points are reduced in the passages 7. In the embodiment according to FIGS. 1 and 2 every third supporting point is eliminated. Due to this fact a substantial reduction of the pressure drop is achieved in every second heat exchanging passage.

In the passages for the other medium, which are represented by the lower passage 8 in FIG. 1, the number of supporting points is not reduced and, therefore, the flow characteristics are changed in a substantially less extension, but since the volume of the passage is reduced, their flow resistance will usually increase to some extent.

Figure 3:
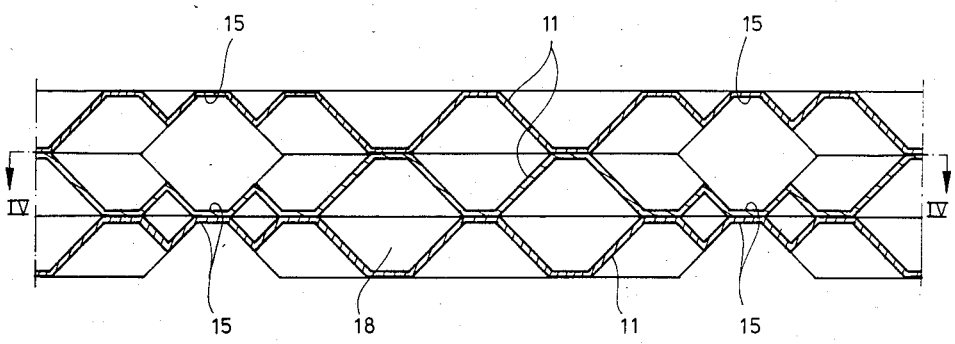
Figure 4:
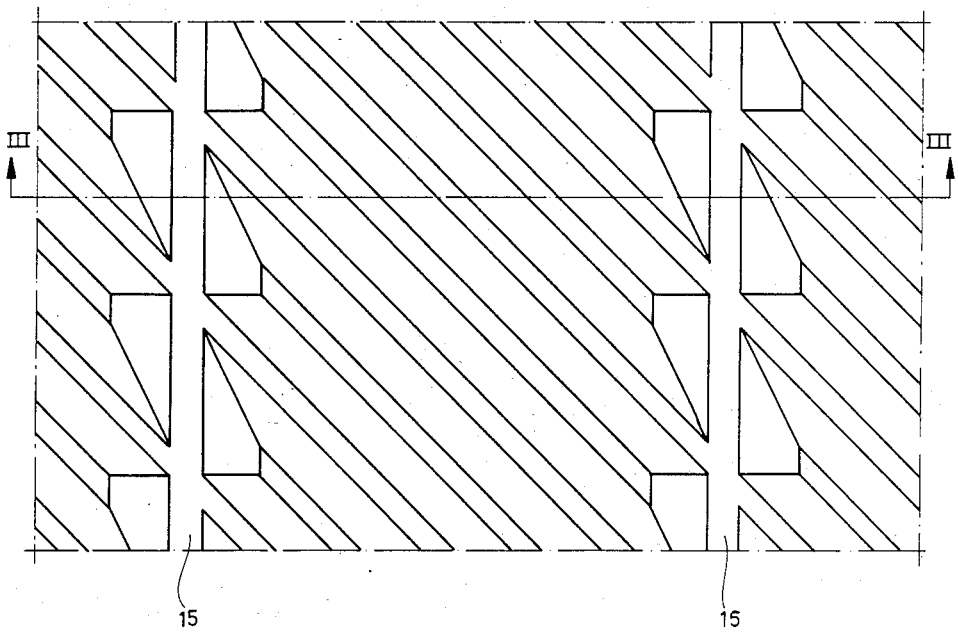

In FIGS. 3 and 4 plates 11 are shown that are arranged in the same way as are the plates 1 in FIGS. 1 and 2 but differ from those by being provided with deeper recesses 15, the depth of which corresponds to the whole embossing depth of the plates. Due to this fact the recesses 15 form continuous resting lines, which bring about a division of the passages 18 into several parallel part passages. Such a division is advantageous in order to prevent flow instability, unbalanced distribution or undesirable flow distribution, which under certain circumstances particularly in connection with evaporation or condensation has a tendency to appear, since the width of the heat exchanging passage is too large in relation to its thickness and length. The division into part passages has also that advantage that the flow speed in the part passages can be influenced to increase or to be reduced and generally for guaranteeing a flow, for instance in condensate outlets or exhaust gas channels in a condensor. The tightness over the resting lines can be secured for instance by glueing, soldering or welding or by means of gaskets.

In order to bring about a good distribution of the flow between the different part passages it is in this connection suitable to arrange restrictions to the flow, which in a way known of those skilled in the art, can be brought about by means of some suitable form of area restriction, as small inlet and outlet openings or particular restriction means put into suitable places in the passages. The restrictions as to evaporators of different types and boilers are suitably placed in the inlet of each part passage and as to condensors in the outlets of non-condensable gases and/or condensate.

Figure 5:
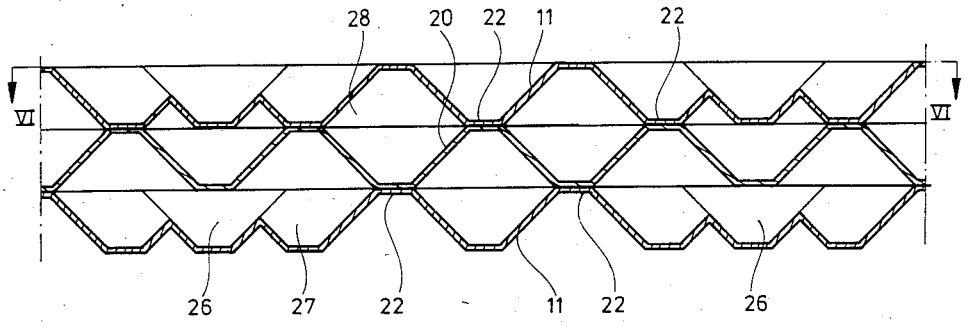
Figure 6:
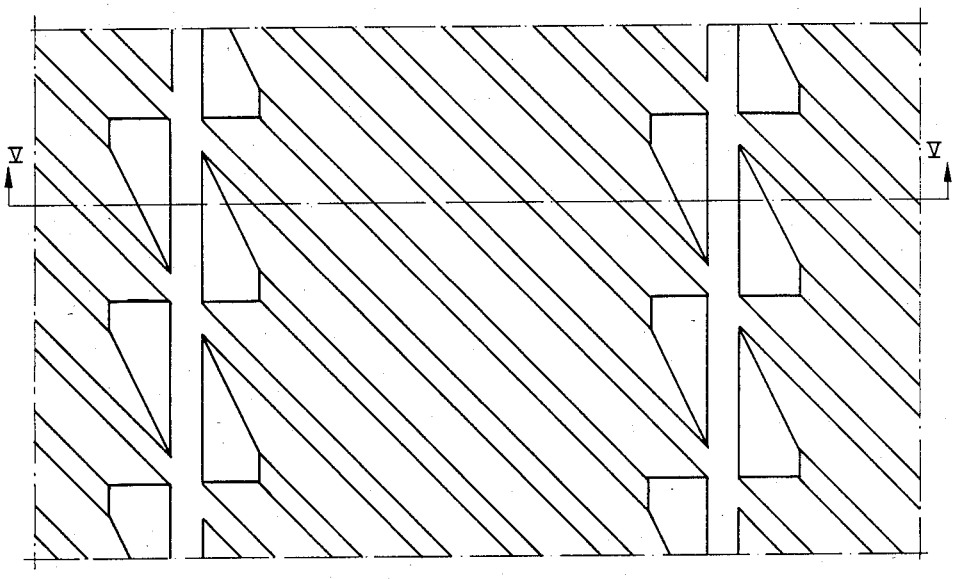

In that in FIGS. 5 and 6 disclosed embodiment two plates 11 according to FIG. 3 have been combined with an intermediate conventional plate 20 without recesses. Due to that fact has been formed a passage 27 with reduced number of supporting points 22, and a passage 28 with retained number of supporting points but without longitudinal resting lines.

It is easily perceived that besides the above described embodiments many changes of the recesses are possible as to form, dimensions and orientation over the surface of the plate. By the disclosed placement of the recesses in rows in the longitudinal direction of the plate, the pressure drop sinking effect is strengthened, but the recesses can have any arbitrary placement, which in each particular case can appear to be suitable for resistance reasons or flow-technical reasons. They can for instance be arranged in rows across or obliquely against the longitudinal direction of the plate or in interrupted rows in someone of these directions or not at all in line.

As previously noted, the recesses 5 of each plate, as shown in FIG. 1, are approximately flush with the central plane of the plate, this being a horizontal plane located midway between the ridges on opposite faces of the plate. Thus, the corrugation pattern of each plate forms ridges projecting in opposite directions from this central plane and extending parallel to each other, the ridges on one face of the plate forming parallel grooves on its opposite face.

We claim:

1. In a plate heat exchanger, the combination comprising two adjacent plates defining a passage for flow of a heat exchanging medium, each of said two plates having a central plane and a corrugation pattern forming ridges projecting in opposite directions from said central plane, the ridges on each face of the plate being parallel to the ridges on the opposite face of the plate and forming parallel grooves in said opposite face of the plate, the ridges and grooves of each plate crossing ridges and grooves of the other plate, each plate having first regions where a plurality of ridges of the plate engage a plurality of crossing ridges of the adjacent plate to form a substantial number of supporting points in said passage, ridges of at least one plate having recesses at selected second regions where a plurality of ridges of said one plate would engage a plurality of crossing ridges of the adjacent plate except for said recesses, whereby said number of supporting points in said passage is less than it would have been without said recesses.

2. The combination of claim 1, in which said recesses are located in line with each other along at least one line.

3. The combination of claim 2, in which said recesses are arranged in interrupted rows.

4. The combination according to any of claims 1–3, in which said one plate has a longitudinal direction and a transverse direction, said recesses being located in line with each other in one of said directions.

5. The combination according to any of claims 1–3, in which said ridges and grooves of each plate are formed by embossing the plate to a predetermined depth, said recesses having a depth corresponding to only part of said embossing depth.

6. The combination of claim 1, comprising also a third heat exchange plate defining with a first of said two plates a second passage for flow of a second heat exchanging medium, said third plate having a corrugation pattern of ridges and grooves, said ridges and grooves of each plate being formed by embossing the plate to a predetermined depth, said ridges and grooves of said third plate crossing ridges and grooves of said first plate, said ridges of the third plate engaging crossing ridges of the first plate to form a substantial number of supporting points in said second passage, said plates having a longitudinal direction and a transverse direction, said recesses having a depth corresponding to the entire said embossing depth and being arranged in at least one row in said longitudinal direction, at least one of said passages being divided into several parallel part passages.

* * * * *

UNITED STATES PATENT AND TRADEMARK OFFICE

CERTIFICATE OF CORRECTION

PATENT NO. : 4,605,060

DATED : August 12, 1986

INVENTOR(S) : Jarl A. Andersson; Leif Hallgren

It is certified that error appears in the above—identified patent and that said Letters Patent is hereby corrected as shown below:

Col. 1, line 63, change "Brief Description of Drawings" to--Object and Brief Description of The Invention--.

Signed and Sealed this

Seventeenth Day of February, 1987

*Attest:*

DONALD J. QUIGG

*Attesting Officer*

*Commissioner of Patents and Trademarks*